United States Patent [19]

Enke et al.

[11] 4,239,110

[45] Dec. 16, 1980

[54] CONTAINER FOR PACKAGING WIRE ROLL

[75] Inventors: Peter Enke, Monheim-Baumberg; Helmut Schlickmann, Monheim; Wolfgang Kneuper, Duesseldorf; Ekkehard Frohberg, Dormagen; Arno Mink, Wuppertal; Jürgen Weidenmüller, Dormagen, all of Fed. Rep. of Germany

[73] Assignee: Bayer Aktiengesellschaft, Leverkusen, Fed. Rep. of Germany

[21] Appl. No.: 2,115

[22] Filed: Jan. 8, 1979

[30] Foreign Application Priority Data

Jan. 14, 1978 [DE] Fed. Rep. of Germany ..... 2801598

[51] Int. Cl.[3] ..... B65D 85/67; B65D 85/671

[52] U.S. Cl. ..... 206/396; 229/17 S; 242/55.53; 206/605

[58] Field of Search ..... 206/396, 395, 389, 303, 206/605; 229/17 S; 242/55.53, 170

[56] References Cited

U.S. PATENT DOCUMENTS

| | | | |
|---|---|---|---|
| 2,527,401 | 10/1950 | Daoust | 242/170 |
| 2,921,674 | 1/1960 | Ryder | 242/55.53 |
| 3,000,494 | 9/1961 | Monroe | 242/55.53 |
| 3,913,786 | 10/1975 | Kartasuk | 229/17 S |

*Primary Examiner*—William T. Dixson, Jr.

*Attorney, Agent, or Firm*—Sprung, Felfe, Horn, Lynch & Kramer

[57] ABSTRACT

The container for packaging wire roll, comprising a cover and core made of a single elongate cut-out piece of dimensionally stable flat material which serves both to support the roll and guide the wire as it is rolled off the shaft of a winch.

6 Claims, 2 Drawing Figures

CONTAINER FOR PACKAGING WIRE ROLL

Figure 1:
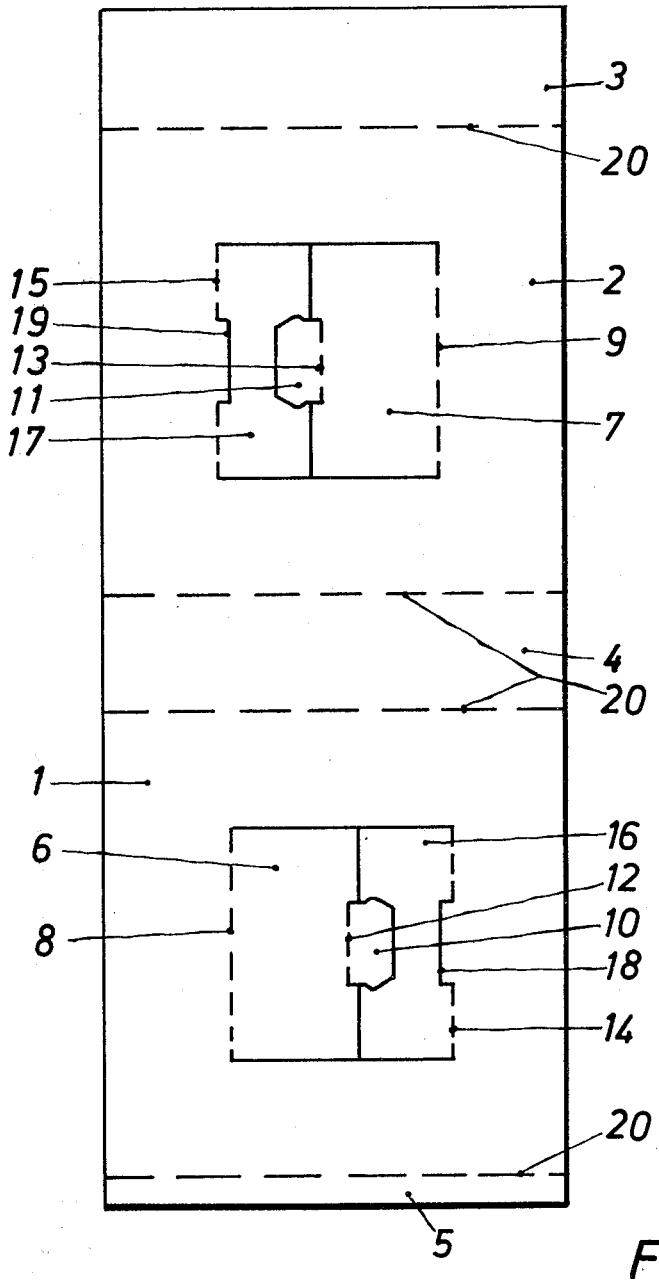

This invention relates to a container for packaging a wire roll comprising a cover and core of dimensionally stable flat material such as corrugated cardboard for all types of wire, in particular plastics wire.

The unwinding of bundles of wire roll occasionally gives rise to difficulties, particularly if a wire as used in agriculture, for example, a bracing wire used in vineyards, is required to be unwound from a large roll, because the wire then frequently tends to get entangled so that it cannot be controlled. Wire rolls supplied in a package are normally removed from their package before use and placed on a special winch on which the roll rotates about a vertical shaft as the wire is pulled off. The wire, which is often pulled over a distance of several hundred meters, tends to get entangled as it is rolled off the winch.

It is an object of the present invention to provide a container for packaging a wire roll which may be used both for supporting the roll and for guiding the wire as it is rolled off the shaft of the winch and which avoids these difficulties.

In the type of container with cover and core mentioned above for packaging a wire roll, the solution according to the invention consists in the cover and core being made of a single elongate cut-out piece, said cover comprising two broad sides and two narrow sides alternating with each other in the longitudinal direction of the cut-out, with a connecting strip hinging to one end, in the longitudinal direction, the width of the broad side being adapted to the overall external diameter of the wire roll and the width of the narrow side being adapted to the thickness of the wire roll measured in the direction of this axis of the roll, the core consisting of two flaps, one provided at the centre of each broad side, each flap having an insertion strip attached to its free end so that when the flap is folded through 90° for packaging, it can be locked in position by insertion of this strip into the opposite broad side, and in the longitudinal direction of the cut-out piece the length of the flap being substantially equal to the width of the narrow side and the width of the flap being smaller than the clear internal diameter of the wire roll.

The wire roll container according to the invention provides for trouble-free unwinding of the wire from a winch in such a manner that the strand of wire inside the packaging container according to the invention rotates on the winch on which it is held firmly by the packaging core according to the invention. This construction of packaging container according to the invention eliminates the possibility of the wire already outside the container getting entangled with the package. Instead of using an insertion strip, the core could, of course, be formed by glueing one flap to the flap which has been folded over from the other broad side.

When preparing the wire roll container according to the invention for use, a tubular cover is first produced by joining the connecting strip at one end of the elongated cut-out piece to the other end of the cut-out piece, in particular by glueing. Into this tube is then placed a bundle of wire, e.g. a plastics wire. Each flap from the two opposite broad sides of the cover is then folded down and locked to the other side by means of its insertion strip.

The core thereby formed holds the wire roll centrally in the package. It also has the effect of preserving the round form of the roll and preventing the different layers of the wire getting entangled with each other. Since the wire roll is generally circular, the broad sides are preferably square and the length of the side of the square is adapted to the external diameter of the wire roll. For the same reason, the core, which is formed by the flaps and kept in position by the insertion strips, is also square in cross-section perpendicular to the winding axis of the wire roll. The core can then be mounted without difficulty on a winch.

A particularly suitable support for a wire roll is obtained if the folding lines of the flaps in the broad sides are parallel to the longitudinal direction of the cut-out. In that case, both the external and the internal periphery of the wire roll are held inside the container in areas at right angles to the winding axis of the roll.

The folding lines of the flaps in the broad sides could conceivably extend at right angles to the longitudinal direction of the cut-out, but the container would then be less stable since it could be shifted into the form of a parallelogram.

For storage, the wire roll packages according to the invention may be stacked either upright or lying flat. In the former case, the winding axis of the wire roll is horizontal and in the latter it is vertical. If the container of the package is made of corrugated cardboard, the corrugations should extend vertically in packages stacked upright in order that the cardboard will have sufficient stability to hold the wire roll inside it. If, on the other hand, the package and hence the wire roll are placed flat, the corrugations in the case of corrugated cardboard are horizontal in the broad sides of the package but vertical in the flaps of the core. Since the flaps in this case play an important role in stabilizing the whole package, they should be made as wide as possible, that is to say either so wide that the distance between the two flaps within the core is only just sufficient to enable the winch to be passed through the core or so wide that the four edges of a square core will just abut against the internal periphery of the wire roll placed inside it. The flaps may be wider than the insertion strips at their ends.

When it reaches the consumer, the wire roll package according to the invention, including its contents, is placed over the core of a winch, in most cases with the package lying flat. The narrow sides of the container are then removed and the wire is unwound from outside. The broad sides of the container, which extend far over the external periphery of the wire roll, prevent the wire from jumping out of position as it is rolled off, and ensure trouble-free unwinding. The folding edges separating the broad sides from the narrow sides are preferably perforated to facilitate removal of the narrow sides.

Figure 2:
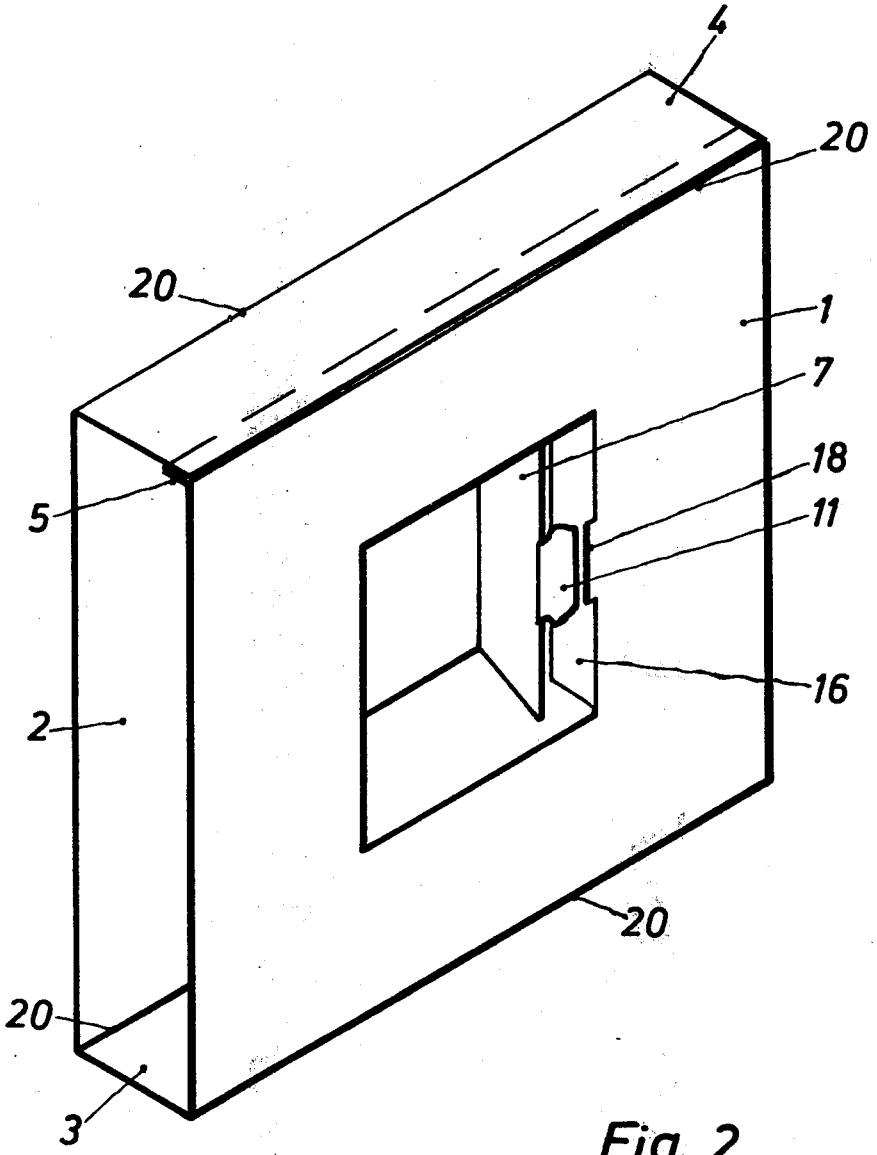

Further details according to the invention are described below with reference to an embodiment given by way of example and illustrated schematically in the drawing, in which FIG. 1 represents the cut-out piece of a packaging container and FIG. 2 shows the container placed upright.

The container cut-out shown in FIG. 1 consists of two broad sides 1 and 2, two narrow sides 3 and 4 and a connecting strip 5. Flaps 6 and 7 are punched into the centre of the broad sides 1 and 2 and designed to be folded about the folding lines 8 and 9 and fixed into position. Insertion strips 10 and 11 are provided at the free ends of the flaps 6 and 7 and designed to be folded about the lines 12 and 13. The flap 6 is designed to be folded about a folding line 8 which is adjacent to the right-hand edge of the cut-out in FIG. 1 while the folding line 9 for the flap 7 is adjacent to the left-hand edge of the cut-out in FIG. 1.

The length of each of the flaps 6 and 7 (between the folding lines 8 and 9 and the insertion strips 10 and 11), is substantially equal to the width of the narrow sides 3 and 4 measured in the longitudinal direction of the cut-out. Since the flaps 6 and 7 are desired to be as wide as possible in the direction of their folding lines 8 and 9 and it is also desirable to have a square core for supporting the wire roll, punching out flaps 6 and 7 leaves a remnant in the form of a strip 16 and 17, respectively, designed to be folded about a folding line 14 or 15, respectively, each of which folding lines 14 and 15 has a slot 18 and 19 for insertion of the appropriate insertion strip 10 or 11.

Perforated folding lines 20 are suitably provided at the boundaries separating the broad sides 1, 2, the narrow sides 3, 4 and the connecting strip 5.

FIG. 2 represents schematically a packaging container according to the invention placed upright. The cover consisting of the broad sides 1, 2 and narrow sides 3, 4 is held together by means of the connecting strip 5, for example by glueing. Inside this tubular cover is another "tube" at right angles thereto. This second "tube" is formed by the flaps 6 and 7 folded inwards and preferably facing the open sides of the cover. FIG. 2 shows how the flap 7 folded away from the plane of the broad side 2 is inserted into the slot 18 of the broad side 1 by means of its insertion strip 11. The flap 7 thus abuts against the strip 16 which has been folded out of the plane of the broad side 1.

When a full package according to the invention is to be put into use, its core is placed over the shaft of a winch. The narrow sides 3 and 4 are then removably torn from the package along the perforated folding lines 20. The roll is then unwound by pulling the wire from outside so that the package rotates abouts its own axis together with the shaft of the winch. Unwinding is exceptionally trouble-free if the shaft of the winch is vertical and the package therefore laid flat. Since the broad sides 1 and 2 extend beyond the external periphery of the wire roll, the wire cannot shift out of place as it is unwound and at the same time the broad sides ensure that the wire can slip sideways without becoming entangled.

List of reference numerals 1, 2=broad sides
3, 4=narrow sides
5=connecting strip
6, 7=flaps
8, 9=folding edges of 6, 7
10,11=insertion strips
12,13=folding edges of 10, 11
14,15=folding edges of 16, 17
16,17=folding strips
18,19=insertion slots
20=perforated folding edges

What we claim is:

1. A container for packaging an unsupported roll of wire formed from a rectangular one-piece blank having two main side panels, a first connecting panel disposed between the two main side panels along the longitudinal direction of the blank and removably connected along two perforated folding lines to the main side panels at their lateral boundaries second connecting panel removably connected to the free lateral edge of one main side panel along a perforated folding line and a connecting strip removably connected along a perforated folding line to the free lateral edge of the other said main side panel, each main side panel having a centrally disposed opening formed by core flaps hingedly connected along one edge to the main side panels with a width equal to that of the connecting panels and having a connecting tongue hingedly connected to the free edge opposite the one edge and a connecting slit for receiving the connecting tongue of the core flap of the other main side panel, the blank being erectable by infolding each of the main side panels 90° about the folding lines of the first connecting panel disposed therebetween, infolding the core flaps 90° and inserting the connecting tongues into their respective connecting slits after insertion of the unsupported roll of wire between the main side panels to define a spool therefor, infolding the second connecting panel and the connecting strip 90° about their folding lines and adhesively connecting the connecting strip to the free lateral edge of said second connecting panel defining an outer container whereby the wire can be unwound from the spool by the tearing away of the connecting panels and connecting strip along the perforated folding lines.

2. Packaging container according to claim 1, wherein said main side panels are square.

3. Packaging container as claimed in claim 2, wherein the cross-section of the core formed by the flaps at right angles to the winding axis of the wire roll being inserted is square.

4. Packaging container as claimed in claim 1, wherein said flaps are wider than the insertion strips provided at their ends.

5. Packaging container as claimed in claim 1, wherein the folding lines of the flaps extend parallel to the longitudinal direction of the blank.

6. The container according to claim 1, wherein the cut-out piece comprises corrugated cardboard.

* * * * *